US005253778A

United States Patent [19]

Sirosh

[11] Patent Number: 5,253,778

[45] Date of Patent: Oct. 19, 1993

[54] FLUID PRESSURE VESSEL BOSS-LINER ATTACHMENT SYSTEM

[75] Inventor: Sadanandan N. Sirosh, Calgary, Canada

[73] Assignee: Edo Canada Ltd., Calgary, Canada

[21] Appl. No.: 827,226

[22] Filed: Jan. 28, 1992

[51] Int. Cl.[5] ..... F17C 1/06

[52] U.S. Cl. ..... 220/590; 220/461; 220/465; 220/901

[58] Field of Search ..... 220/586, 589, 590, 601, 220/611, 901, 461, 465

[56] References Cited

U.S. PATENT DOCUMENTS

| | | | |
|---|---|---|---|
| 3,132,761 | 5/1964 | Sylvester | 220/590 |
| 3,508,677 | 4/1970 | Laibson et al. | 220/590 |
| 3,847,716 | 11/1974 | Dorsch | 220/453 X |
| 3,908,851 | 9/1975 | Jacobs | 220/590 |
| 4,360,116 | 11/1982 | Humphrey | 220/586 |
| 4,491,247 | 1/1985 | Nitchman et al. | 220/586 X |
| 4,690,295 | 9/1987 | Wills | 220/590 |

FOREIGN PATENT DOCUMENTS

| | | | |
|---|---|---|---|
| 2539191 | 3/1976 | Fed. Rep. of Germany | 220/589 |

*Primary Examiner*—Allan N. Shoap

*Assistant Examiner*—Stephen Cronin

*Attorney, Agent, or Firm*—Thorpe North & Western

[57] ABSTRACT

A fluid pressure vessel includes an exterior composite structural shell formed with a cylindrical sidewall and first and second dome-shaped end sections with two axially aligned openings in the end sections. An interior fluid impermeable liner is disposed in the shell to fit against the inside surface thereof, and includes two openings, each aligned with and adjacent to a respective one of the openings in the shell. A pair of end bosses are each disposed in respective adjacent openings of the shell and liner. The improvement of the invention involves forming the bosses so that each includes a cylindrical neck and an annular collar extending radially outwardly from the neck, and forming the perimeters of the openings in the liner each with a first radially inwardly projecting section for overlying the top of the collar of a respective boss, and a second section projecting from an underside of the first section radially inwardly for underlying the bottom of the collar of a respective boss. The first and second sections define an annular recess therebetween for receiving and encapsulating a collar of a boss to hold it in place in the pressure vessel.

8 Claims, 2 Drawing Sheets

FLUID PRESSURE VESSEL BOSS-LINER ATTACHMENT SYSTEM

BACKGROUND OF THE INVENTION

This invention relates generally to fluid pressure vessels which incorporate non-metallic liners, and in particular to a new and improved system and structure for attaching bosses used in such vessels to the liners.

Composite (fiber reinforced resin matrix) containers or vessels have come into common use for storage of a variety of fluids under pressure, including storage of oxygen, natural gas, nitrogen, rocket fuel, propane, etc. Such composite construction provides numerous advantages such as lightness in weight and resistance to corrosion, fatigue and catastrophic failure. This combination of lightness in weight and resistance to failure is possible due to the high specific strengths of the reinforcing fibers or filaments (carbon, glass, aramid, etc.) which, in the construction of pressure vessels, are typically oriented in the direction of the principal forces.

Since the resin matrix of the composite pressure vessel (shell) is subject to cracking and crazing during service and use, the vessels are oftentimes furnished with fluid impermeable liners. While metal liners are most common, elastomeric rubber and thermoplastic liners have also been utilized. Advantageously, the liners are designed not only to prevent leaks from the vessel, but also to serve as mandrels during the vessel fabrication—i.e., profile definition for the composite shell.

Maximum structural efficiency is attained when the lightweight composite shell is used to carry the majority of the load, with little contribution from the liner; and so if metal liners are used, the liner must be relatively thin in order to reduce the weight. However, thin metal liners have low fatigue life and because of this problem of sacrificing a low weight for durability, and vice versa, users have increasingly looked to use non-metallic liners which are lighter in weight and yet fluid impervious.

One problem with the use of non-metallic liners is that of securely attaching the liners to the vessel bosses which are typically metallic. The end-bosses support fluid passage into and out of the vessel and also may function in the fabrication of the composite shell by providing for fiber turnaround at the ends or poles of the vessel and for mandrel support if filament winding is used to construct the shell. When metal liners are used, such bosses are generally constructed integrally with the liners, but with the increased use of non-metallic liners, other methods of attaching the bosses to the liners have been needed. Some prior approaches to attaching non-metallic liners to bosses have included adhesive-bonding of the boss to the liner (if the liner is sufficiently rigid), and simple reliance on the internal pressure in the vessel to provide a boss-liner seal (if the liner is a flexible, collapsible membrane). FIGS. 2 and 3 of the drawings illustrate these two approaches for attaching non-metallic liners to bosses, and will be discussed momentarily.

The above two approaches, however, present problems including breakdown under fatigue cycling or exposure to certain environments of the metal (boss) to non-metallic (liner) bonding, disintegration of the bond because of significantly different coefficients of thermal expansion of most metals versus non-metals, and shifting of the liner in the shell (if only internal pressure is relied upon) giving rise to leak paths through the boss-liner joint.

In addition to the need for properly attaching the liner to the bosses, it is also important to provide a shear layer at the composite shell/metallic boss interface to reduce the tendency for large shear stresses to develop at that interface. In the past, rubberized compounds have been utilized for such layers but these are prone to disintegrate over time.

SUMMARY OF THE INVENTION

It is an object of the invention to provide a new and improved system for attaching liners of fluid pressure vessels to end bosses of the vessels.

It is also an object of the invention to provide such a system which is especially suitable for attaching non-metallic liners to metal or similarly rigid bosses.

It is a further object of the invention to provide such a system in which the likelihood of fluid leaks between a pressure vessel liner and bosses is reduced.

It is an additional object of the invention to provide such a system in which the vessel liner/boss attachment structure also serves as a shear layer between the bosses and outer shell of the vessel.

It is another object of the invention to provide such a system in which the internal fluid pressure in the vessel is utilized to enhance the attachment of the liner to the bosses.

The above and other objects of the invention are realized in a specific illustrative embodiment of a pressure vessel for holding fluids which includes an outer shell made of a substantially rigid, mechanically strong material such as composite fiber-reinforced resin, and having at least one oblate end section with an opening therein. Also included is a boss having a neck portion for fitting in the opening of the outer shell and a flange portion extending outwardly from one end of the neck portion. An inner, generally fluid impervious liner is disposed within the outer shell against the inside surface thereof and includes at least one end section with an opening aligned with the opening of the outer shell. The inner liner is formed with a dual-layer lip circumscribing the opening in the liner and having an upper lip segment and a lower lip segment, with an annular recess therebetween for receiving and holding the flange portion of the boss. In effect, the flange portion of the boss is encapsulated in the recess between the upper and lower lip segments of the liner which securely holds it in place.

In accordance with one aspect of the invention, the boss includes a generally cylindrical hollow extending through the neck portion to define a first opening at said one end of the neck portion from which the flanged portion extends, and a second opening at the other end of the neck portion. The lower lip segment is formed to extend radially inwardly under the flanged portion of the boss and then upwardly through the first opening and along the wall of the hollow of the boss to a location at which an attachment, such as a valve, is received into the hollow through the second opening. In this manner, the liner is directly coupled to the attachment to provide a more leak-free joint.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
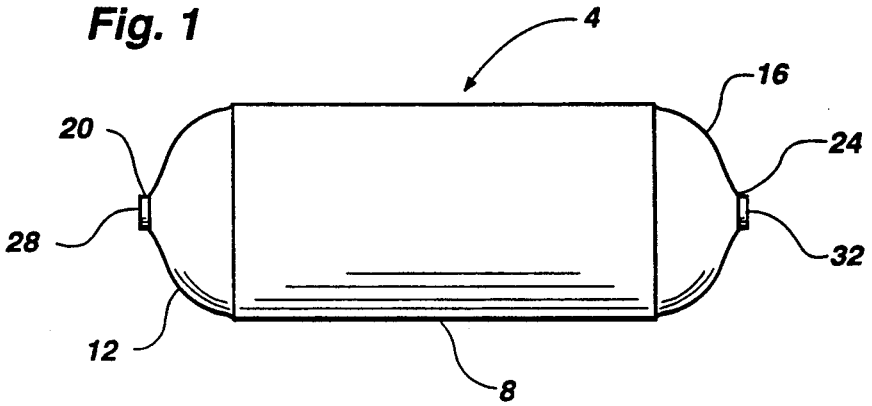
FIG. 1 is a side, elevational view of a composite vessel of the type for which the present invention is especially suitable.

Referring to the drawings, there is shown in FIG. 1 a typical composite (fiber-reinforced resin) pressure vessel 4, in which the present invention may be utilized. The vessel 4 includes a hollow generally cylindrical central section, and integral oblate end sections 12 and 16. The end sections 12 and 16 include axially-aligned openings 20 and 24 in which are disposed access bosses 28 and 32 respectively. As discussed earlier, the bosses 28 and 32 are typically constructed of metal or metal alloy and are provided for receiving attachments such as valves to allow for the supply of fluid into and removal of fluid from the vessel 4. The bosses 28 and 32 are also typically used, during fabrication of the vessel, for fiber turnaround and mandrel support.

Although the bosses 28 and 32 are shown positioned in the end sections 12 and 16, sometimes called polar sections, the bosses may be placed at other locations, and more than two bosses may be provided. Also, fully spherical vessels could be provided as could other conventional container shapes, with bosses provided where desired.

Figure 2:
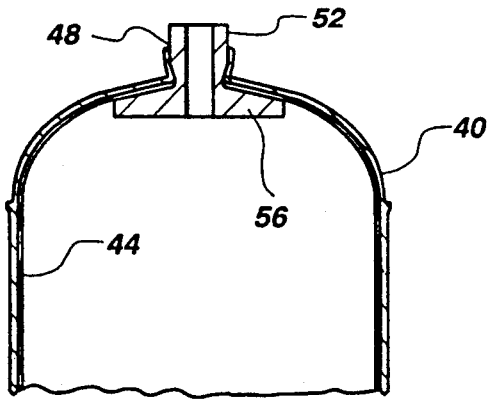
Fig. 2 PRIOR ART
FIG. 2 is a side, cross-sectional, fragmented view of a composite vessel with an elastomeric liner attached to a boss utilizing only internal pressure of the fluid in the vessel, in accordance with a conventional prior art approach.
Figure 3:
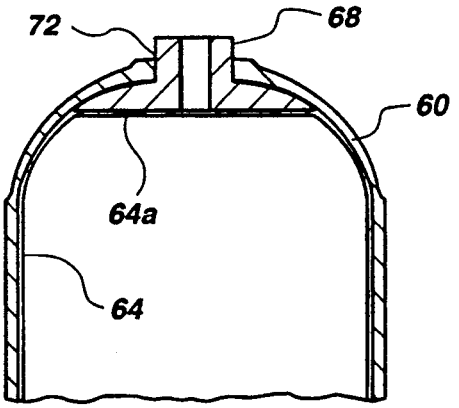
Fig. 3 PRIOR ART
FIG. 3 is a side, cross-sectional, fragmented view of a composite vessel having a rigid non-metallic liner bonded to a boss in a conventional fashion.

FIGS. 2 and 3 show prior art approaches to attaching a non-metallic liner, used in vessels of the type shown in FIG. 1, to the end bosses. In particular, FIG. 2 shows a side, cross-sectional, fragmented view of a composite vessel shell 40 in which is disposed an elastomeric rubber liner 44. The liner 44 is positioned against the inside surface of the shell 40 and extends to an opening 48 in the shell. A boss 52 is disposed in the opening 48 and includes a lower flange portion 56 which is positioned against the liner 44 surrounding the opening 48. With this prior art configuration, the internal pressure in the vessel against the boss 52 is used to help seal the liner 44 against the boss. However, in the event of an internal vacuum in the vessel, the seal is likely to break down, drawing contaminants into the vessel and causing leak paths to develop between the boss 52 and liner 44. Internal vacuums oftentimes occur even for vessels intended for pressure use, such as when a vessel is partially filled with fluid which then cools down to produce the vacuum.

FIG. 3 illustrates, in side, cross-sectional, fragmented view, a shell 60 of a pressure vessel, in which is disposed a rigid non-metallic liner 64. A boss 68 is disposed in an opening 72 of the shell 60 and is adhesively bonded to a top wall 64*a* of the liner to provide the desired seal between the liner and the boss. However, as previously mentioned, non-metallic materials (such as plastic)-to-metal adhesive bonding is difficult to maintain, when used in boss-liner attachment, and it generally deteriorates over time and service, leading to leakage at the boss-liner interface.

Figure 4:
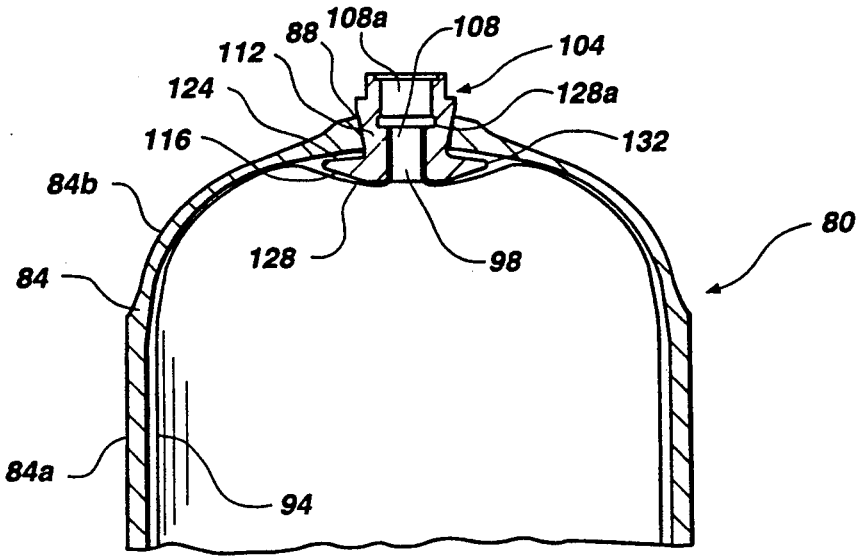
FIG. 4 is a side, cross-sectional fragmented view of a fluid pressure vessel made in accordance with the principles of the present invention.

FIG. 4 shows a side, cross-sectional, fragmented view of a fluid pressure vessel 80 made in accordance with the present invention. The pressure vessel 80 includes an exterior shell 84 having a hollow cylindrical center section 84*a* and two (only one of which is shown) oblate, generally ellipsoidal end sections 84*b* which are formed integral with the center section. Axially aligned openings 88 (only one of which is shown) are formed in the end sections 84*b* as indicated in FIG. 4. The shell 84 is formed of a composite fiber-reinforced resin in the conventional manner.

Disposed inside the shell 84 is a fluid impermeable liner 94 made, for example, of a thermoplastic material such as polyethylene, nylon polyamide, or polyethylene terephthalate (PET). The liner 94 is disposed against the inside surface of the shell 84 and thus has the same general form as the shell including a pair of openings 98 (only one of which is shown) which are aligned with respective openings 88 of the shell.

Disposed in the adjacent openings 88 and 98 of the shell and liner respectively is an end boss 104, typically made of a metal or metal alloy such as aluminum or carbon chromium-molybdenum alloy steel. The boss 104 is formed with an axial cylindrical hollow or bore 108, an upper portion 108*a* of which is for receiving an attachment, such as a valve, for supplying fluid into and removing fluid from the vessel 80. The boss 104 is also formed with a generally cylindrical neck portion 112 and which fits within the opening 88 of the shell 84, and a collar or flange portion 116 extending radially outwardly from the lower end of the neck portion, as best seen in FIG. 5B. The lower surface of the flange 116 is formed to be generally convex and includes rounded edges 116*a* between the lower surface of the flange and the interior sidewall 118 of the hollow 108. Similarly a transition 116*b* between the top of the flange portion 116 and the neck portion 112 is smooth and rounded. The reason for this is to aid in reducing stress concentrations in the boss and in the liner which will follow the boss contours, as will be described hereafter.

Formed in the hollow 108 of the boss 104 is a circumferential groove 120 (FIG. 5B) which, as will be explained later, is for receiving a portion of the liner 94 for aid in holding the liner securely in place.

That portion of the liner 94 surrounding the opening 98 in the liner is formed into a dual-lip arrangement to include an upper lip segment 124 which circumscribes the neck portion 112 of the boss 104 when the boss is in place, and overlies the upper surface of the flange portion 116 of the boss, as best seen in FIG. 4. The dual-lip configuration of the liner 94 also includes a lower lip segment 128 which extends from the underside of the upper lip segment 124 radially inwardly under the lower surface of the flange portion 116 of the boss, and then upwardly into the hollow 108 along the walls 118 of the hollow, again as best seen in FIG. 4. The termination of the lower lip segment 128 is formed into an annular bead 128*a* which fits within the circumferential groove 120 of the boss 104 and serves to hold the lower lip segment 128 in place in the hollow 108. The upper lip segment 124 and the lower lip segment 128 define an annular recess 132 between the two segments for receiving and, in effect, encapsulating and holding the flange portion 116 of the boss 104, as shown in FIG. 4.

With the dual-lip configuration of the liner 94 and the design of the boss 104 with a flange portion 116 that is received and encapsulated within the recess 132 between the lip segments 124 and 128, there is no need for adhesively bonding the boss to the liner. The design of the boss 104 also accommodates use of internal fluid pressure in the vessel for enhancing adherence of the liner 94 to the boss. In particular, the internal pressure forces the lower lip segment 128 against the bottom surface of the flange portion 116 and against the walls 118 of the hollow 108. Such pressure also forces the bead 128*a* of the lower lip segment 128 into the circumferential groove 120. This groove 120 and the locking of the bead 128*a* of the lower lip segment 128 therein serves to prevent slippage of the liner 94 during pressurization and depressurization. Also, positioning the lower lip segment 128 in the hollow 108 at the location of the circumferential groove 120 provides a direct link between the liner 94 and the inlet portion 108*a* of the hollow 108 (where an attachment, such as a valve, would be received) to thereby minimize the likelihood of leak paths developing.

The upper lip segment 124 of the liner 94 is disposed between the boss 104 and the shell 84 and, in particular, between the flange portion 116 of the boss and the shell to act as a shear layer as previously mentioned.

Figure 5A:
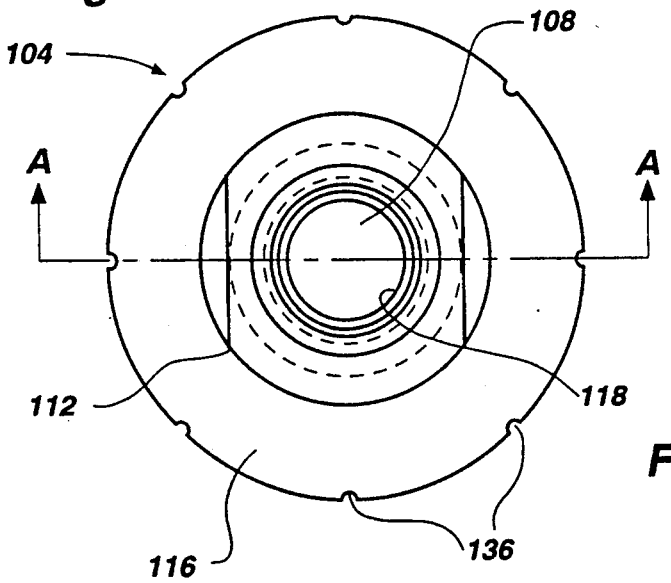
FIGS. 5A and 5B show respectively a top, plan view of a pressure vessel boss made in accordance with the principles of the present invention, and a side, cross-sectional view of the boss taken along lines A—A of FIG. 5A.
Figure 5B:
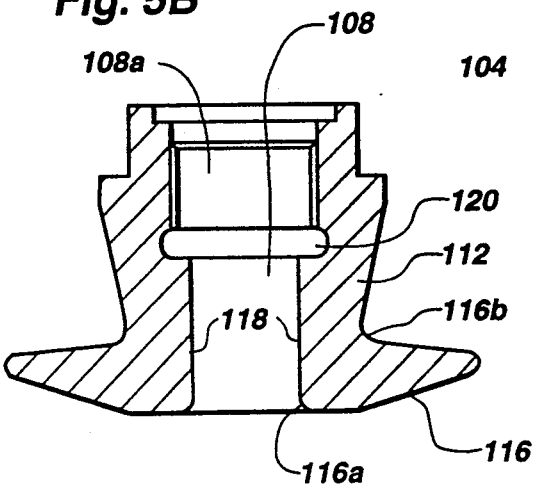

To enhance torque transfer between the boss 104 and the liner 94, cogs or notches 136 are formed at spaced-apart locations in the perimeter of the flange portion 116, as best seen in FIG. 5A. These notches 136 are positioned to contact the walls of the annular recess 132 between the upper lip segment 124 and lower lip segment 128 to assist in the torque or torsional shear transfer between the boss and liner. The upper surface and lower surface of the flange portion 116 of the boss 104 may also be roughened or otherwise treated to prevent the sliding thereover of the upper lip segment 124 and lower lip segment 128 respectively to further enhance the torque transfer.

It is to be understood that the above-described arrangements are only illustrative of the application of the principles of the present invention. Numerous modifications and alternative arrangements may be devised by those skilled in the art without departing from the spirit and scope of the invention and the appended claims are intended to cover such modifications and arrangements.

What is claimed is:

1. A pressure vessel for holding fluids comprising:

an outer shell made of a substantially rigid, mechanically strong material, and having at least one oblate end section with an opening therein, boss means having a neck portion for fitting in the opening in the outer shell and a flange portion extending outwardly from one end of the neck portion, and an inner, generally fluid impervious liner disposed in the outer shell against the inside surface thereof, and having at least one end section with an opening aligned with the opening of the outer shell, said inner liner being formed with a dual-layer lip circumscribing the opening in the liner and having an upper lip segment and a lower lip segment, with an annular recess therebetween for receiving and holding therein the flange portion of the boss means, and wherein the flange portion of the boss means includes an outer rim having a plurality of notches spaced thereabout for contacting the recess wall of the dual-layer lip.

2. A pressure vessel having an exterior composite structural shell formed with a cylindrical sidewall and first and second dome-shaped end sections with two axially aligned openings in the end sections, an interior fluid impermeable liner shaped to fit against the inside surface of the shell and having two opening, each aligned with and adjacent to a respective one of the openings in the shell, and a pair of end bosses each disposed in respective adjacent openings of the shell and liner, characterized in that:

the bosses are each formed with a cylindrical neck and an annular collar extending radially outwardly from the neck, and the perimeters of the openings in the liner are each formed with a first radially inwardly projecting section for overlying the top of the collar of a respective boss to serve as a shear layer between the boss and shell, and a second section projecting from an underside of the first section radially inwardly for underlying the bottom of the collar of a respective boss, said first and second sections defining an annular recess therebetween for receiving and encapsulating a respective collar therein.

wherein at least one of the bosses includes a bore centrally formed in the neck thereof, one end of the bore being adapted for receiving thereinto an attachment which extends to a predetermined location in the bore, and wherein the lower section of the opening perimeter in which said at least one boss is disposed extends inwardly underneath the collar of the one boss and upwardly through the other end of the bore to said predetermined location, and wherein the collar extends outwardly to terminate in a perimeter having a plurality of notches formed therein at spaced-apart locations about the perimeter for engaging the walls of the recess.

3. A pressure vessel for holding fluids comprising an outer shell made of a substantially rigid, mechanically strong material, and having at least one oblate end section with an opening therein, boss means having a neck portion for fitting in the opening in the outer shell and a flange portion extending outwardly from one end of the neck portion, wherein the flange portion includes an outer rim, a generally fluid impervious liner disposed within the outer shell against the inside surface thereof, and having at least one end section with an opening aligned with the opening of the outer shell, said liner being formed with a dual-layer lip circumscribing the opening in the liner and having an upper lip segment and a lower lip segment, the outer rim having a plurality of notches for contacting the recess wall of the dual-layer lip, with an annular recess therebetween for receiving and holding therein the flange portion of the boss means.

4. A pressure vessel as in claim 3 wherein said outer shell is made of a composite fiber-reinforced resin material, wherein said inner liner is made of a non-metallic material, and wherein said boss means is made of metal or metal alloy.

5. A pressure vessel as in claim 3 wherein said boss means includes a generally cylindrical hollow extending through the neck portion to define a first opening at said one end of the neck portion, and a second opening at the other end of the neck portion, and wherein said lower lip segment is formed to extend radially inwardly under the flange portion of the boss means and then upwardly through the first opening and along the wall of the hollow of the boss means.

6. A pressure vessel as in claim 5 wherein said flange portion includes a lower surface under which said lower lip segment extends, and an upper surface over which said upper lip segment extends, said lower surface being generally radially convex.

7. A pressure vessel as in claim 6 wherein the lower surface and the upper surface of the flange portion of the boss means have a rough, non-skid texture to inhibit sliding thereover of the lower lip segment and upper lip segment respectively.

8. A pressure vessel as in claim 5 wherein the hollow of the boss means includes a circumferential groove formed in the wall of the hollow, and wherein said lower lip segment terminates in an annular bead which fits in the groove of said hollow.

* * * * *